US006431220B1

(12) United States Patent
Nakada et al.

(10) Patent No.: US 6,431,220 B1
(45) Date of Patent: Aug. 13, 2002

(54) TAKE-UP MOTION TENSION AND/OR PRESSURE CONTROL SYSTEM

(75) Inventors: Akihiko Nakada; Zenji Tamura; Kazuto Kakutani; Yasunori Oota, all of Kanazawa (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 0 days.

(21) Appl. No.: 09/985,811

(22) Filed: Nov. 6, 2001

(30) Foreign Application Priority Data

Nov. 7, 2000 (JP) ..... 2000-339039
Nov. 7, 2000 (JP) ..... 2000-339040

(51) Int. Cl.[7] ..... D03D 49/20
(52) U.S. Cl. ..... 139/311; 242/547; 242/535.3
(58) Field of Search ..... 139/311; 242/547, 242/535.3

(56) References Cited

U.S. PATENT DOCUMENTS 3,871,598 A * 3/1975 Kataoka ..... 242/413.2
4,150,797 A * 4/1979 Kataoka ..... 242/541.6

FOREIGN PATENT DOCUMENTS

JP 52-21807 5/1977
JP 60-17151 1/1985

* cited by examiner

*Primary Examiner*—Andy Falik
(74) *Attorney, Agent, or Firm*—Wenderoth, Lind & Ponack, L.L.P.

(57) ABSTRACT

A take-up control system for controlling a take-up motion included in a loom controls the take-up motion according to the diameter of a roll of cloth being woven on the loom so that a proper tension is exerted on the cloth. A take-up controller included in the take-up control system controls a torque-controllable motor for driving a cloth roller to take up the cloth in the roll on the basis of an electric signal representing the diameter of the roll according to a control program to exert a properly adjusted tension on the cloth. The take-up controller can also control an actuator for pressing a pressing member against the circumference of the roll according to weaving conditions, or weaving conditions and the diameter of the roll, to apply a properly adjusted pressure to the roll by the pressing member.

19 Claims, 7 Drawing Sheets

TAKE-UP MOTION TENSION AND/OR PRESSURE CONTROL SYSTEM

BACKGROUND OF THE INVENTION

1. Field of the Invention

The present invention relates to a take-up motion control system for a loom, capable of driving a cloth roller, i.e., winding roller, by a controllable motor to take up cloth woven on the loom in a roll of cloth, and of controlling the tension of the cloth by a program according to the variation of the diameter of the roll of cloth.

2. Description of the Related Art

A known technique disclosed in JP-A No. 60-17151 interlocks a cloth roller, i.e., a winding roller, with a drive shaft by a friction clutch, which serves as a mechanical brake, including a friction plate and a pressure plate. The pressure plate is pressed against the friction plate by an appropriate pressure so that the friction plate and the pressure plate may properly slip relative to each other and a proper braking force may be generated. The driving force of the main shaft of the loom may be transmitted to the cloth roller to rotate the cloth roller by a predetermined torque.

This known technique measures change in the diameter of the roll of cloth mechanically, and adjusts the pressure pressing the pressure plate against the friction plate mechanically according to the change of the diameter of the roll of cloth to control the cloth tension by changing the torque of the drive shaft for driving the cloth roller. The relation between the cloth tension F, the torque T of the drive shaft and the radius R of the roll of cloth is expressed by $F=T/R$.

Even if the torque of the drive shaft for driving the cloth roller is controlled mechanically according to the change of the diameter of the roll of cloth by this known technique, the cloth tension cannot be properly adjusted according to the variation of the diameter of the roll of cloth and, consequently, the cloth is liable to be creased. If creases are defects in the cloth, the cloth cannot be woven in a satisfactory quality unless the braking force is adjusted while the loom is in operation.

The braking force can be adjusted by controlling the mechanical brake according to the diameter of the roll of cloth by an actuator, such as apneumatic cylinder actuator. However, the ability of the mechanical brake deteriorates with time and the braking performance of the mechanical brake changes as the components thereof are abraded. Therefore, the mechanical brake needs periodic maintenance. The braking force can be generated by a powder clutch, and can be controlled by electrically controlling the powder clutch. However, the performance of powder included in the powder clutch changes with time and the powder clutch needs periodic maintenance.

A known technique disclosed in JP-U No. 52-21807 suspends a cylindrical member, i.e., a pressure roller, having a length greater than the width of a roll of cloth formed by rolling cloth so as to press the roll of cloth to roll the cloth around a cloth roller in a uniform, satisfactory shape. The pressure roller is pressed against the roll of cloth by its own weight or by elastic members, such as springs. Thus, the cloth is rubbed by the pressure roller before the same is taken up on the cloth roller. The pressure roller applies pressure uniformly to the entire roll of cloth as the cloth roller rotates to prevent the formation of creases in the cloth rolled in the roll of cloth.

Since the pressure roller applies a fixed pressure to the roll of cloth regardless of different weaving conditions for different types of cloth, the pressure roller is unable to prevent the formation of creases in the cloth under some weaving conditions. Since the pressure applied to the roll of cloth remains constant regardless of the variation of the diameter of the roll of cloth, an appropriate pressure, which must be varied according to the diameter of the roll of cloth, cannot be applied to the roll of cloth having a variable diameter and hence creases are liable to be formed in the rolled cloth.

A plurality of pressure rollers respectively having different weights may be selectively used according to weaving conditions to prevent the formation of creases in the rolled cloth. However, management of parts necessary for the selective use of the plurality of pressure rollers is troublesome and is practically infeasible.

SUMMARY OF THE INVENTION

Accordingly, it is a first object of the present invention to achieve the appropriate control of winding tension exerted on cloth being taken up in a roll of cloth on a cloth roller according to the change of the diameter of the roll of cloth without requiring any periodic maintenance work.

The cloth roller is driven for rotation by a torque-controllable motor to control tension exerted on the cloth by a program control mode according to the change of the diameter of the roll of cloth formed by rolling the cloth on the cloth roller.

According to a first aspect of the present invention to achieve the first object of the present invention, a take-up motion control system for controlling a take-up motion included in a loom comprises: a torque-controllable motor for driving a cloth roller, a diameter measuring device capable of providing an electric signal representing the diameter of a roll of cloth formed by winding cloth around the cloth roller, and a motor controller capable of controlling the torque-controllable motor according to a control program on the basis of the electric signal provided by the diameter measuring device and representing the diameter of the roll of the cloth.

The take-up motion control system according to the first aspect of the present invention executes the tension control program for controlling the torque-controllable motor on the basis of the electric signal representing the diameter of the roll of cloth to adjust the tension exerted on the cloth properly according to the diameter of the roll of cloth. Thus, the formation of creases in the cloth rolled in the roll of cloth can be prevented and any maintenance work is not necessary because the take-up motion control system does not include any device subject to deterioration with time, such as a mechanical brake.

In the take-up motion control system according to the first aspect of the present invention, proper tensions are determined for different diameters of the roll including a minimum diameter at the start of winding the cloth and a maximum diameter at the end of winding the cloth according to weaving conditions, and a tension control program for controlling tension exerted on the cloth according to the variation of the diameter of the roll from the minimum to the maximum diameter is created. Since the tension control program for controlling the tension exerted on the cloth according to the variation of the diameter of the roll from the minimum to the maximum diameter is created, appropriate tensions can be exerted on the cloth according to the diameter of the roll of cloth. Hence, the formation of creases in the cloth rolled in the roll of cloth can be prevented even if the cloth is of a delicate type.

In the take-up motion control system according to the first aspect of the present invention, a graph indicating the relation between the diameter of the roll of cloth and the tension may be created on the basis of the tension control program, and the set tensions may be changed by shifting a point or a line on the graph. Since the set tensions are thus changeable by shifting the point or the line on the graph indicating the relation between the diameter of the roll of cloth and the tension, desired values can be readily set and changed, tension setting work can be achieved in a short time, and dispersion in set tensions between different looms can be prevented.

In the take-up motion control system according to the first aspect of the present invention, a present tension and a present roll of cloth diameter may be measured and displayed. When a present tension and a present roll of cloth diameter are measured and displayed, a tension and a diameter when the cloth rolled in the roll of cloth is creased can be recognized, and the set values can be properly changed to prevent the formation of creases in the cloth rolled in the roll of cloth.

In the take-up motion control system according to the first aspect of the present invention, the tension control program specifies set tensions individually for a state where the loom is in operation and a state where the loom is stopped, changes from a control mode using the set tensions for the state where the loom is in operation to a control mode using the set tensions for the state where the loom is stopped in a set time when the loom is stopped, and changes from the control mode using the set tensions for the state where the loom is stopped to the control mode using the set tensions for the state where the loom is in operation in a set time when the loom is started. Thus an appropriate tension can be exerted on the cloth in both the state where the loom is in operation and the state where the loom is stopped, and hence the formation of creases in the cloth at the start of the loom can be prevented.

In the take-up motion control system according to the first aspect of the present invention, the cloth roller may be capable of being rotated in either a normal direction or a reverse direction by operating a switch while the loom is stopped. The cloth roller may also be capable of being stopped automatically after the cloth roller has been rotated in the normal or the reverse direction for a predetermined time or after the cloth roller has been rotated through an angle corresponding to a predetermined length of the cloth. When the cloth roller can be rotated in the normal or the reverse direction by operating the switch while the loom is stopped, and when the cloth roller can be automatically stopped after the same has been rotated for the predetermined time or through the angle corresponding to the predetermined length of the cloth, the cloth will not be damaged by the excessive rotation of the cloth roller.

In the take-up motion control system according to the first aspect of the present invention, the cloth roller may be reversed for a predetermined time or through a predetermined angle to slacken the cloth on the loom upon the coincidence of a count counted by a pick counter with a predetermined number. Since the cloth roller is reversed after a predetermined length of cloth has been woven and the loom has been stopped to slacken the cloth on the loom, the roll of cloth can be unloaded from the loom by an automatic roll of cloth unloading operation.

A second object of the present invention is properly controlling pressure applied to a roll of cloth formed by winding a woven cloth by a pressing member according to weaving conditions and the diameter of the roll of cloth.

The pressing member pressed against the roll of cloth is driven by an actuator while the cloth is being wound around a cloth roller. The actuator is controlled according to weaving conditions or according to weaving conditions and the diameter of the roll of cloth to control the presser applied by the pressing member to the roll of cloth.

According to a second aspect of the present invention to achieve the second object of the present invention, a take-up motion control system for controlling a take-up motion for winding cloth around a cloth roller in a roll on a loom comprises: a pressing member placed in contact with a circumference of the roll wound on the cloth roller with its axis in parallel to that of the cloth roller, an actuator for pressing the pressing member against the roll and applying an adjusted pressure to the roll by the pressing member, and a take-up controller for controlling the actuator to adjust the pressure applied to the roll by the pressing member according to weaving conditions. The pressing member may have a length shorter than the width of the cloth or may consist of a plurality of segments. The actuator may be a pressure-controlled cylinder actuator operated by fluid pressure, a torque-controllable motor whose torque is controllable or an electromagnetically controlled solenoid actuator. Weaving conditions include the type of the cloth, weaving speed and such.

The controller of the take-up motion control system according to the second aspect of the present invention drives the actuator according to weaving conditions to apply an adjusted pressure to the circumference of the roll by the pressing member. Since the pressure applied to the roll is thus adjusted properly according to weaving conditions, the formation of creases in the cloth wound in the roll of cloth can be surely prevented.

According to a third aspect of the present, a take-up motion control system for controlling a take-up motion for winding cloth around a cloth roller in a roll on a loom comprises: a pressing member placed in contact with a circumference of the roll wound on the cloth roller with its axis in parallel to that of the cloth roller, an actuator for pressing the pressing member against the roll and applying an adjusted pressure to the roll by the pressing member, a diameter measuring device capable of providing an electric signal representing information about a diameter of the roll wound on the cloth roller, and a take-up controller for controlling the actuator according to weaving conditions to apply an adjusted pressure to the roll by the pressing member and executing a control program to control the actuator on the basis of the electric signal provided by the diameter measuring device. The information about the diameter of the roll is a measured diameter of the roll or a calculated diameter of the roll calculated on the basis of the length of the cloth woven on the loom or the number of picks inserted in the cloth woven on the loom. Operations for controlling the actuator according to the control program includes changing actuator driving mode on the basis of a program designed according to the diameter of the roll.

The controller of the take-up motion control system according to the third aspect of the present invention drives the actuator according to weaving conditions to apply an adjusted pressure to the circumference of the roll by the pressing member, and controls the operation for driving the actuator according to the control program on the basis of the diameter of the roll. The pressure applied to the roll can be properly adjusted according to the diameter of the roll, and the formation of creases in the cloth wound in the roll of cloth can be prevented from the start to the end of winding the cloth around the cloth roller.

In the take-up motion control system according to the second or the third aspect of the present invention, proper set pressures to be applied to the roll may be determined respectively for different diameters of the roll, such as diameters of the roll respectively at the start, the middle and the end of winding the roll, for weaving conditions. In addition, a pressure control program for controlling the pressure to be applied to the roll according to the change of the diameter of the roll may be created on the basis of those set pressures. When the proper set pressures are thus determined respectively for different diameters of the roll for weaving conditions, and the pressure control program for controlling the pressure to be applied to the roll is created on the basis of those set pressures, a proper pressure can be applied to the roll according to the diameter of the roll of cloth. Hence, the formation of creases in the cloth wound in the roll of cloth can be prevented even if the cloth is of a delicate type.

In the take-up motion control system according to the second or the third aspect of the present invention, a graph indicating the relation between the diameter of the roll and the pressure to be applied to the roll may be created on the basis of the pressure control program, and the set pressures maybe changed by shifting a point or a line on the graph. Since the set pressures are thus changeable by shifting the point or the line on the graph indicating the relation between the diameter of the roll and the pressure to be applied to the roll, desired values can be readily set and changed, pressure setting work can be achieved in a short time, and dispersion in set pressures between different looms can be prevented.

In the take-up motion control system according to the second or the third aspect of the present invention, a current pressure applied to the roll of cloth and a current diameter of the roll of cloth (length of the cloth woven on the loom or the number of picks) may be measured and displayed. When a current pressure applied to the roll and a current diameter of the roll are measured and displayed, a pressure applied to the roll and a diameter of the roll when the cloth rolled in the roll is creased can be recognized, and the set values can be properly changed to prevent the formation of creases in the cloth rolled in the roll.

In the take-up motion control system according to the second or the third aspect of the present invention, the pressure control program may specify set pressures individually for a state where the loom is in operation and a state where the loom is stopped, may change from a control mode using the set pressures for the state where the loom is in operation to a control mode using the set pressures for the state where the loom is stopped in a set time when the loom is stopped, and may change from the control mode using the set pressures for the state where the loom is stopped to the control mode using the set pressures for the state where the loom is in operation in a set time when the loom is started. Thus an appropriate pressure can be applied to the roll in both the state where the loom is in operation and the state where the loom is stopped, and hence the formation of creases in the cloth at the start of the loom can be prevented.

In the take-up motion control system according to the second or the third aspect of the present invention, a pressure applying operation of the pressing member for applying a pressure to the roll may be stopped and started by manually operating a switch. The control of the pressure applying operation by the manual operation of the switch facilitates work for unloading the roll of cloth from the loom.

In the take-up motion control system according to the second or the third aspect of the present invention, the pressure applying operation of the pressing member for applying a pressure to the roll may be stopped automatically upon the coincidence of a count counted by a pick counter with a predetermined number. Since the loom is stopped and the pressure applied to the roll of cloth is removed automatically upon the coincidence of the count counted by the pick counter with the predetermined number, the roll can be unloaded from the loom by an automatic unloading operation.

DETAILED DESCRIPTION OF THE INVENTION

First Embodiment

Figure 1:
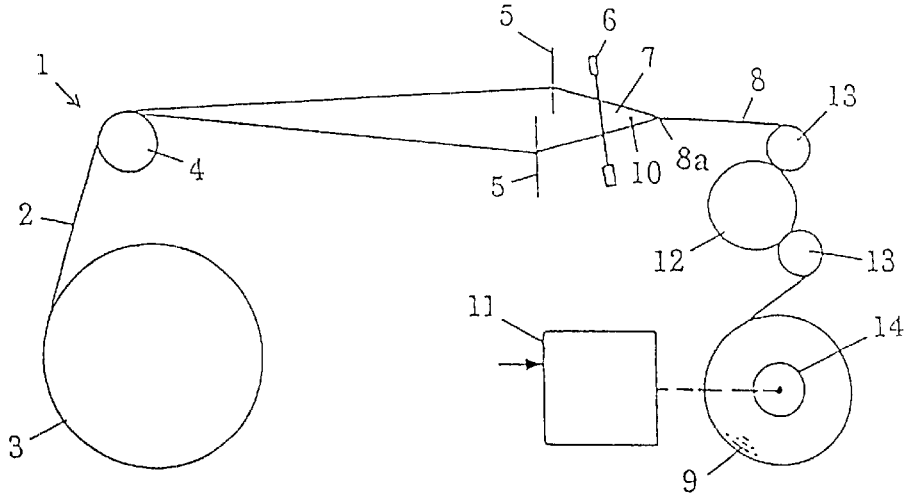
FIG. 1 is a diagrammatic view of an essential part of a loom and a take-up motion control system in a first embodiment according to the present invention included in the loom.
Figure 6:
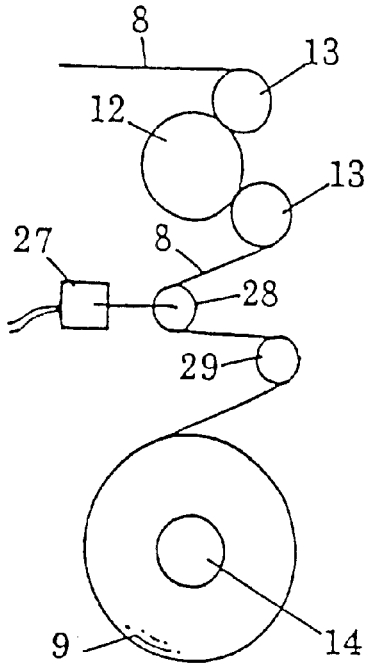
FIG. 6 is a side elevation of assistance in explaining a method of measuring tension exerted on the cloth.

Referring to FIG. 1 showing a loom 1 to which the present invention is applied, warps 2 unwound from a warp beam 3 and let off in a sheet by a let-off motion extend around a back roller 4 and through heddles 5 and a reed 6 to a cloth fell 8*a* of cloth 8. The heddles 5 raise and lower the warps 2 selectively to form a shed 7. A weft 10 is inserted in the shed 7 of the warps 2 and is beaten up into the cloth fell 8*a* of the cloth 8 by the reed 6. The cloth 8 is taken up on a cloth roller 14 by a take-up device including a first pressure roller 13, a surface roller 12, a second pressure roller 13, and can also include a movable roller 28 and a stationary roller 29 as shown in FIG. 6. The cloth 8 is extended around the first pressure roller 13, the surface roller 12 and the second pressure roller 13. The cloth roller 14 is driven and controlled by a take-up motion control system 11 in a first embodiment according to the present invention.

Figure 2:
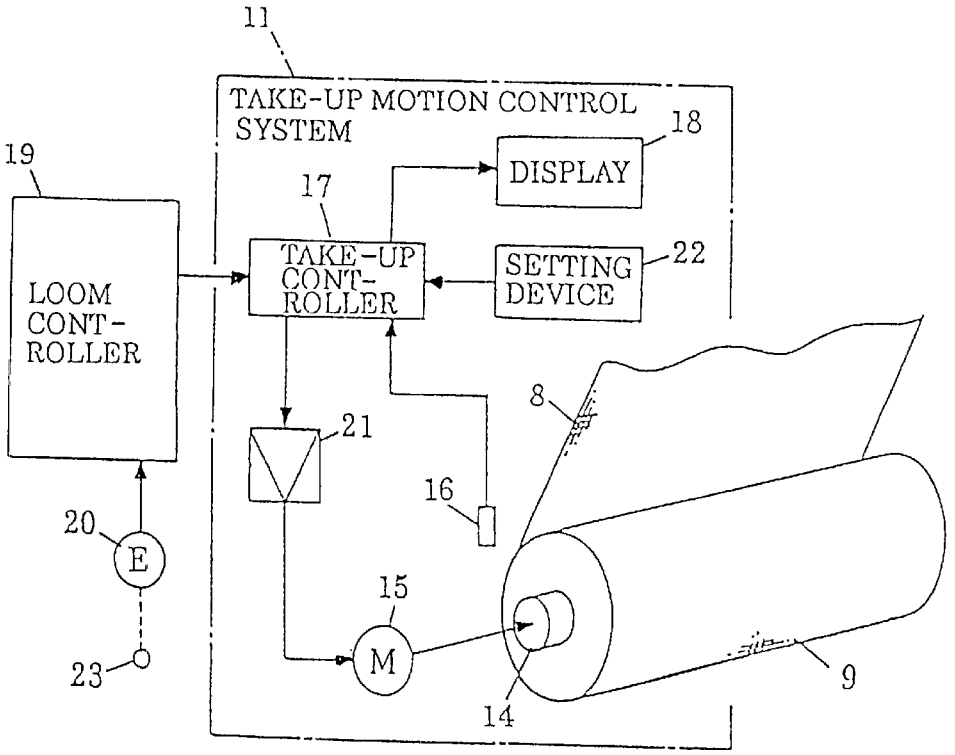
FIG. 2 is a block diagram of the take-up motion control system shown in FIG. 1.

Referring to FIG. 2, the take-up motion control system 11 includes, as essential components, a torque-controllable motor 15, a diameter measuring device 16, a take-up controller 17, a display 18, an amplifier 21, and a setting device 22. A loom controller 19 measures the angular position of the main shaft 23 of the loom 1 on the basis of a signal provided by an encoder 20 and controls the loom 1 for weaving operation.

The torque-controllable motor 15 is a torque motor or a servomotor capable of exerting a predetermined torque to drive the cloth roller 14 for rotation. The diameter measuring device 16 determines the diameter of the roll 9 formed by winding the cloth 8 on the cloth roller 14 through the direct measurement of the diameter or through calculation on the basis of the length of the woven cloth or the number of picks. The diameter measuring device 16 gives an electric signal representing the diameter of the roll 9 to the take-up controller 17.

The take-up controller 17 receives set data from the setting device 22, data representing the diameter of the roll 9 from the diameter measuring device 16, and signals including a signal representing the angular position of the main shaft 23 measured by the encoder 20 from the loom controller 19. The take-up controller 17 executes a control program to adjust the rotation and torque of the motor 15 on the basis of the diameter of the roll 9.

The take-up controller 17 controls the motor 15 according to the diameter of the roll 9 to prevent the formation of creases in the cloth 8 by exerting a proper tension on the cloth 8. Since the take-up motion control system 11 does not have any devices that wear with time, such as a mechanical brake, the take-up motion control system 11 does not need special maintenance work.

The operator operates the setting device 22 to set optimum tensions to be exerted on the cloth 8 for diameters of the roll 9 of the cloth 8 at different weaving stages, such as an initial weaving stage, a middle weaving stage and a final weaving stage, according to weaving conditions. The take-up controller 17 creates a tension control program to exert proper tensions on the cloth 8 at different weaving stages from the start to the end of the weaving operation according to the diameter of the roll 9. The take-up controller 17 executes the tension control program during the weaving operation. Thus, the formation of creases in the cloth 8 can be prevented even if the cloth 8 is of a delicate type. The take-up controller 17 displays a graph indicating the relation between the diameter of the roll 9 and the tension exerted on the cloth 8 on the screen of the display 18. The set tensions can be changed by shifting a point or a line on the graph.

Figure 3:
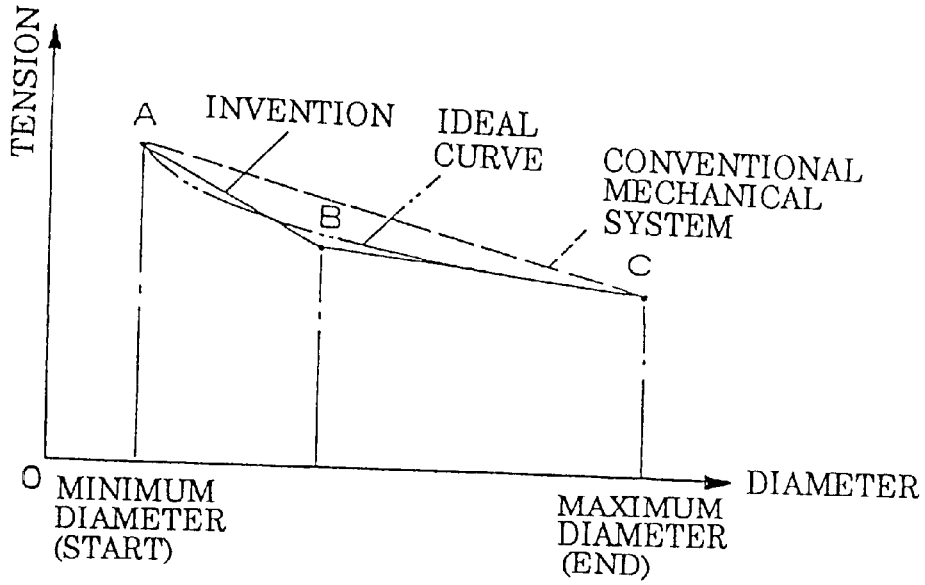
FIG. 3 is a graph showing the relation between the diameter of a roll of cloth and the tension exerted on cloth.

FIG. 3 shows a graph indicating the relation between the diameter of the roll 9 and the tension exerted on the cloth 8, and points A, B and C indicate optimum tensions specified by operating the setting device 22 to be exerted on the cloth 8 at the initial weaving stage where the roll 9 has a minimum diameter, the middle weaving stage, and the final weaving stage where the roll 9 has a maximum diameter, respectively. Theoretically, the tension exerted on the cloth 8 is varied along the continuous lines passing the points A, B and C. Actually, the tension is varied substantially along an ideal curve indicated by a two-dot chain line owing to the response characteristic of the control system. In FIG. 3, a dash line indicates the relation between the diameter of the roll of cloth and the tension exerted on the cloth 8, when the tension is controlled by a conventional mechanical control system. The graph showing the relation between the diameter of the roll 9 and the tension exerted on the cloth 8 facilitates setting operations for setting and changing set values, reduces time necessary for the setting operations and prevents the difference in set values between looms.

The take-up controller 17 displays the set tensions (set winding torque), set diameters of the roll 9 (length of the woven cloth or the number of picks) and the measured or calculated present tension and the measured or calculated present diameter in addition to the graph showing the relation between the diameter and the tension on the display 18. Those parametric values are plotted on the graph or tabulated in tables. The current tension and the current diameter thus displayed on the display 18 can be recognized when the cloth 8 is creased and, when necessary, can be properly changed to prevent the further formation of creases in the cloth 8.

The tension of the cloth 8 corresponds to a torque applied to the cloth roller 14, and the diameter of the roll 9 corresponds to the length of the cloth 8 woven on the loom 1 or the number of picks inserted in the cloth 8. The current diameter of the roll 9 is determined through the direct measurement of the diameter of the roll 9 by the diameter measuring device 16 or is determined indirectly through calculation on the basis of data measured by the diameter measuring device 16.

Figure 4:
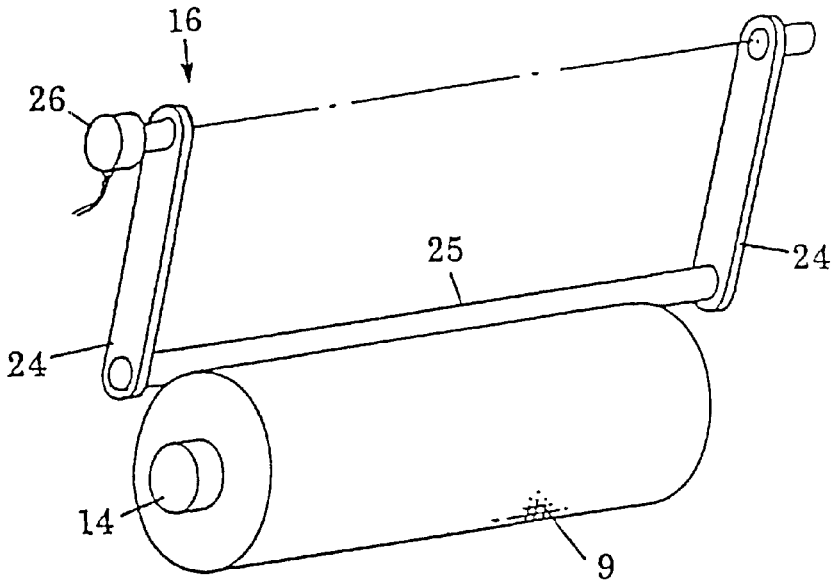
FIG. 4 is a perspective view of assistance in explaining a method of measuring the diameter of the roll of cloth.
Figure 5:
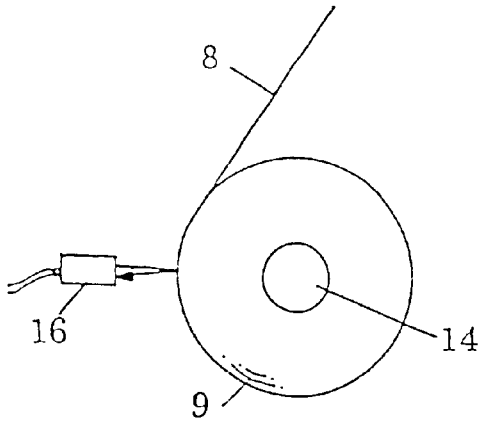
FIG. 5 is a side elevation of assistance in explaining a method of measuring the diameter of the roll of cloth.

FIGS. 4 and 5 show possible examples of the diameter measuring device 16. A diameter measuring device 16 shown in FIG. 4 has a contact roller 25 having a length equal to or greater than the width of the cloth 8, having opposite ends rotatably supported on free ends of a pair of swing arms 24, and is placed in contact with the roll 9. The angular position of the pair of swing arms 24 corresponds to the diameter of the roll 9. An angular position of the swing arms 24 is measured and converted into a corresponding diameter by a potentiometer 26. A diameter measuring device 16 shown in FIG. 5 is a non contact distance measuring device provided with a range sensor.

FIG. 6 shows a tension measuring device. As shown in FIG. 6, a load cell 27 is connected to the movable roller 28 supported for movement. The cloth 8 is extended along a Z-shaped path and is wound around the movable roller 28 and the stationary roller 29. The load cell 27 provides a signal representing a tension exerted on the cloth 8. A tension exerted on the cloth 8 corresponds to a winding torque applied to the cloth roller 14.

Different values are assigned to each of the parameters of the tension control program respectively for a state where the loom 1 is in operation and a state where the loom 1 is stopped. When the loom 1 is stopped, the values of the parameters are changed in a specified time from those for the state where the loom 1 is in operation to those for the state where the loom 1 is stopped. When the loom 1 is started, the values of the parameters are changed in a specified time from those for the state where the loom 1 is stopped to those for the state where the loom 1 is in operation.

Thus, an optimum tension is exerted on the cloth 8 while the loom 1 is stopped to prevent the formation of creases in the cloth 8 when the weaving operation is resumed.

The operator operates a switch included in the loom controller 19 to rotate the stopping cloth roller 14 in the normal or the reverse direction. The cloth roller 14 thus rotated is stopped automatically after the same has been rotated for a predetermined time or through an angle corresponding to a predetermined weaving length to avoid damaging, soiling and forming creases in the cloth 8 due to operator's inadvertent failure in stopping the cloth roller 14.

The operator operates a switch included in the loom controller 19 to rotate the stopping cloth roller in either a normal or a reverse direction. After the cloth roller 14 has been rotated for a predetermined time, the cloth roller 14 is stopped automatically to avoid damaging, soiling and forming creases in the cloth 8 due to operator's inadvertent failure in stopping the cloth roller 14. The tension control program is designed to reverse the cloth roller 14 automatically for a predetermined time or to unwind the cloth 8 by a predetermined length upon the coincidence of the count counted by the pick counter included in the loom controller 19 with a predetermined number to slacken the cloth. Thus, a roll unloading operation can be automated.

Second Embodiment

Figure 7:
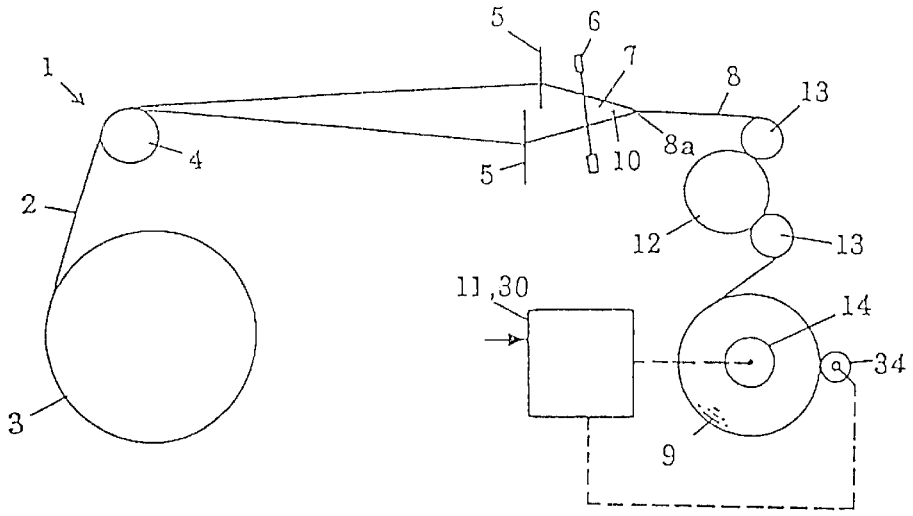
FIG. 7 is a diagrammatic view of an essential part of a loom and a take-up motion control system in a second embodiment according to the present invention included in the loom.

FIG. 7 shows an essential part of an ordinary loom 1, warps 2 unwound from a warp beam 3 and let off in a sheet by a let-off motion to extend around a back roller 4 and through heddles 5 and a reed 6 to a cloth fell 8*a* of cloth 8. The heddles 5 raise and lower the warps 2 selectively to form a shed 7. A weft 10 is inserted in the shed 7 of the warps 2 and is beaten up into the cloth fell 8*a* of the cloth 8 by the reed 6. The cloth 8 is taken up on a cloth roller 14 by a take-up device including a first pressure roller 13, a surface roller 12 and a second pressure roller 13. The cloth 8 is extended around the first pressure roller 13, the surface roller 12 and the second pressure roller 13.

A pressing member 34 is extended with its axis in parallel to the axis of the cloth roller 14 and is pressed against the roll 9 of the cloth 8 wound on the cloth roller 14 to apply a proper pressure to the roll 9 so that the formation of creases in the cloth 8 can be prevented. The cloth roller 14 and the pressing member 34 are controlled by an electrical take-up motion control system 11 in a second embodiment according to the present invention.

Figure 8:
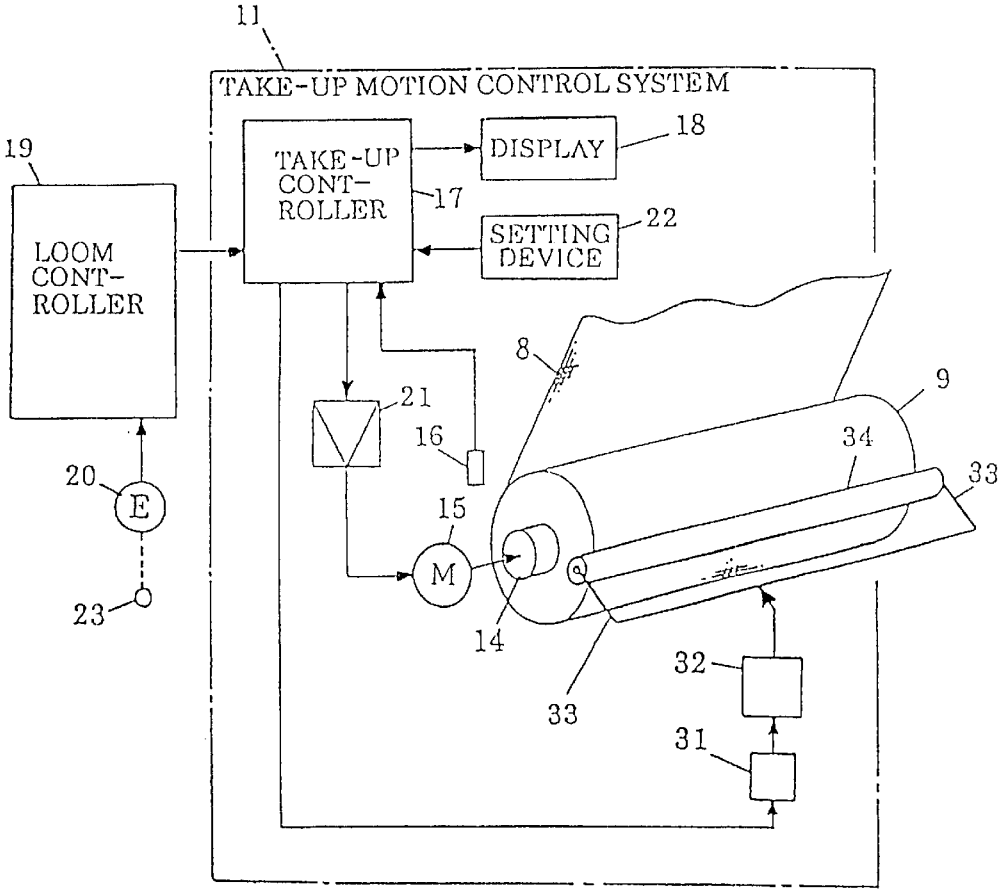
FIG. 8 is a block diagram of the take-up motion control system shown in FIG. 7.

Referring to FIG. 8, the take-up motion control system 11 includes, as essential components, a torque-controllable motor 15, a diameter measuring device 16, a take-up controller 17, a display 18, an amplifier 21, a setting device 22, the pressing member 34, an actuator 31 and a pressure applying mechanism 32. A loom controller 19 measures the angular position of the main shaft 23 of the loom 1 on the basis of a signal provided by an encoder 20, controls the loom 1 for weaving operation, and gives signals necessary for control, including a signal representing the angular position of the main shaft 23 of the loom 1 to the take-up motion control system 11.

The torque-controllable motor 15 is a torque motor or a servomotor capable of exerting a predetermined torque to drive the cloth roller 14 for rotation. The diameter measuring device 16 determines the diameter of the roll 9 formed by winding the cloth 8 on the cloth roller 14 through direct measurement or through calculation on the basis of the length of the woven cloth or the number of picks. The diameter measuring device 16 gives an electric signal representing the diameter of the roll 9 to the take-up controller 17.

The pressing member 34 may be a roller supported for rotation on arms 33 of the pressure applying mechanism 32, or may be a slippery rod fixedly supported on the arms 33 of the pressure applying device 32. The pressing member 34, i.e., the roller or the slippery rod, may have a length equal to or shorter than that of the roll 9, and may be a single member or may consist of a plurality of segments. The actuator 31 may be a cylinder actuator operated by fluid pressure, a motor whose torque is controllable or an electromagnetically controlled solenoid actuator.

The take-up controller 17 receives set data from the setting device 22, data representing the diameter of the roll 9 from the diameter measuring device 16, and signals including a signal representing the angular position of the main shaft 23 measured by the encoder 20 from the loom controller 19. The take-up controller 17 executes a tension control program and a pressure control program. The diameter of the roll 9 is determined through the direct measurement of the diameter or through calculation on the basis of the length of the woven cloth or the number of picks. The control programs include a program created according to weaving conditions and the diameter of the roll 9 including the step of driving the actuator 31 to adjust the pressure applied to the roll 9.

The take-up controller 17 executes the tension control program designed for the specific diameter of the roll 9 to adjust the rotation and the output torque of the motor 15. The take-up controller 17 executes the pressure control program designed for the particular type of cloth 8, the cloth winding speed and such and, when necessary, executes a program designed for the specified diameter of the roll 9 to adjust the pressure applied to the circumference of the roll 9 by the pressing member 34 by controlling the actuator 31 and the pressure applying mechanism 32.

The pressure control according to the weaving conditions is capable of applying a proper pressure to the roll 9 according to the weaving conditions and hence the formation of creases in the cloth 8 can be surely prevented when the weaving conditions are changed.

The pressure control according to the diameter of the roll 9 is capable of applying a proper pressure to the roll 9 according to the weaving conditions and of applying different proper pressures to the roll 9 for different diameters of the roll 9. Thus, the formation of creases in the cloth 8 can be perfectly prevented from the start to the completion of weaving the cloth 8.

The operator operates the setting device 22 before starting the loom 1 to set optimum tensions to be exerted on the cloth 8 and optimum pressures to be applied to the roll 9 for diameters of the roll 9 at different weaving stages, such as an initial weaving stage, a middle weaving stage and a final weaving stage, according to weaving conditions. The take-up controller 17 creates a tension control program to exert proper tensions on the cloth 8 at different weaving stages from the start to the end of the weaving operation according to the diameter of the roll 9. The take-up controller 17 also creates a pressure control program to apply proper pressures to the roll 9 by pressing member 34 at different weaving stages from the start to the end of the weaving operation according to the change of the diameter of the roll 9 on the basis of the set tensions.

Since the tension control exerts the optimum tensions on the cloth 8 according to the diameter of the roll 9, the formation of creases in the cloth 8 can be prevented even if the cloth 8 is of a delicate type. Since the pressure control applies the optimum pressures on the roll 9 according to the diameter of the roll 9, the formation of creases in the cloth 8 can be prevented even if the cloth 8 is of a delicate type.

The take-up controller 17 displays a graph indicating the relation between the diameter of the roll 9 and the tension exerted on the cloth 8 on the screen of the display 18 according to the tension control program. The set tensions can be changed by shifting a point or a line on the graph as the diameter of the roll 9 increases.

Figure 9:
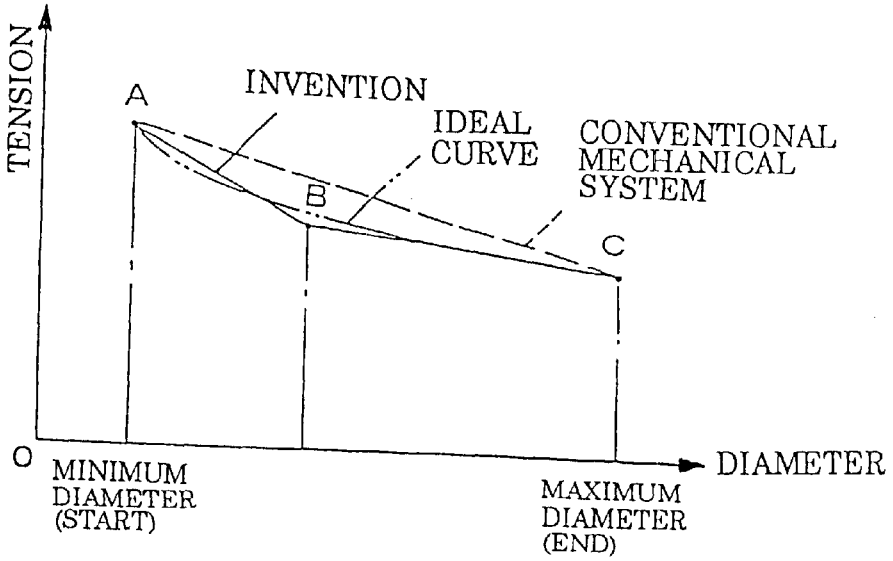
FIG. 9 is a graph showing the relation between the diameter of the roll of cloth and the tension force exerted on the cloth.

FIG. 9 shows a graph indicating the relation between the diameter of the roll 9 and the tension exerted on the cloth 8, and points A, B and C indicate optimum tensions specified by operating the setting device 22 to be exerted on the cloth 8 for diameters of the roll 9 at stages between the start to the end of winding the roll 9. Theoretically, the tension exerted on the cloth 8 is varied along the continuous lines passing the points A, B and C. Actually, the tension is varied substantially along an ideal curve indicated by a two-dot chain line owing to the response characteristic of the control system. In FIG. 9, a dashed line indicates the relation between the diameter of the roll of cloth and the tension exerted on the cloth 8 when the tension is controlled by a conventional mechanical control system. The graph showing the relation between the diameter of the roll 9 and the tension exerted on the cloth 8 facilitates setting operations for setting and changing set values, reduces time necessary for the setting operations and prevents the difference in set values between looms. The take-up controller 17 displays a graph indicating the relation between the diameter of the roll 9 and the pressure applied to the roll 9 on the display 18 according to the pressure control program. A point or a line on the graph is moved as the diameter of the roll 9 increases to enable changing the set pressures.

Figure 10:
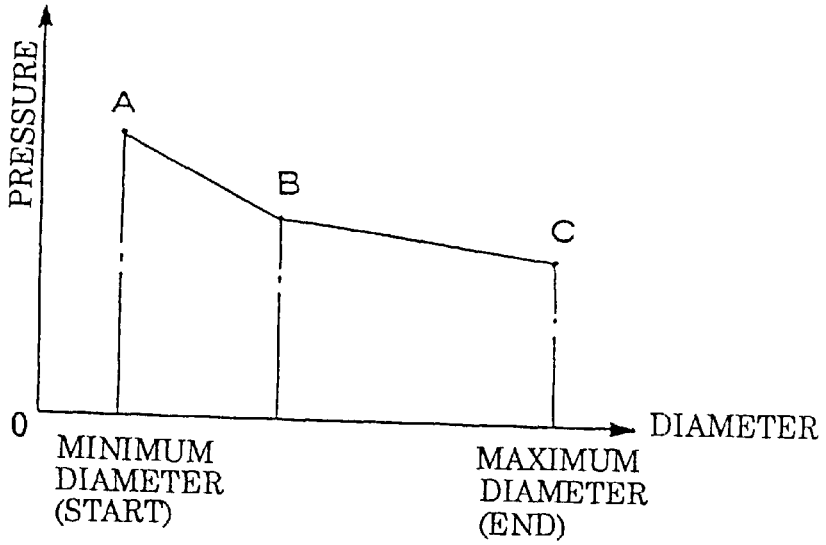
FIG. 10 is a graph showing the relation between the diameter of the roll of cloth and the pressure applied to the roll of cloth.

FIG. 10 shows a graph indicating the relation between the diameter of the roll 9 and the pressure applied to the roll 9, and points A, B and C indicate optimum pressures specified by operating the setting device 22 to be applied to the roll 9 for diameters of the roll 9 at stages between the start and the end of winding the roll 9. Theoretically, the pressure applied to the roll 9 is varied along the continuous lines passing the points A, B and C. Actually, the pressure is varied smoothly substantially along continuous lines owing to the response characteristic of the control system.

The graph showing the relation between the diameter of 6 the roll 9 and the pressure applied to the roll 9 facilitates setting operations for setting and changing set pressures, reduces time necessary for the setting operations and prevents the difference in set values between looms.

When executing the control programs, the take-up controller 17 displays the measured or calculated current tension, the measured or calculated current diameter of the roll 9, the measured or calculated pressure and the measured or calculated diameter of the roll 9 (length of the woven cloth or the number of picks) on the display 18. Those parametric values are plotted on the graphs or tabulated in tables. The current pressure and the current diameter thus displayed on the display 18 can be readily recognized when the cloth 8 is creased and can be properly changed to prevent the further formation of creases in the cloth 8.

The tension of the cloth 8 corresponds to a torque applied to the cloth roller 14, and the diameter of the roll 9 corresponds to the length of the cloth 8 woven on the loom 1 or the number of picks inserted in the cloth 8. The current diameter of the roll 9 is determined through the direct measurement of the diameter of the roll 9 by the diameter measuring device 16 or is determined indirectly through calculation on the basis of data on the length of the cloth 8 woven on the loom 1 and the number of picks inserted in the cloth 8.

Different values are assigned to each of the parameters of the tension control program respectively for a state where the loom 1 is in operation and a state where the loom 1 is stopped. When the loom 1 is stopped, the values of the parameters are changed in a specified time from those for the state where the loom 1 is in operation to those for the state where the loom 1 is stopped. When the loom 1 is started, the values of the parameters are changed in a specified time from those for the state where the loom 1 is stopped to those for the state where the loom 1 is in operation. Thus, an optimum tension is exerted on the cloth 8 while the loom 1 is stopped to prevent the formation of creases in the cloth 8 when the weaving operation is resumed.

Different values are also assigned to each of the parameters of the pressure control program respectively for a state where the loom 1 is in operation and a state where the loom 1 is stopped. When the loom 1 is stopped, the values of the parameters are changed in a specified time from those for the state where the loom 1 is in operation to those for the state where the loom 1 is stopped. When the loom 1 is started, the values of the parameters are changed in a specified time from those for the state where the loom 1 is stopped to those for the state where the loom 1 is in operation. Thus, an optimum pressure is applied to the roll 9 while the loom 1 is stopped to prevent the formation of creases in the cloth 8 when the weaving operation is resumed.

Different values are assigned to each of the parameters of the pressure control program respectively for a state where the loom 1 is in operation and a state where the loom 1 is stopped. When the loom 1 is stopped, the values of the parameters are changed in a specified time from those for the state where the loom 1 is in operation to those for the sate where the loom 1 is stopped. When the loom 1 is started, the values of the parameters are changed in a specified time from those for the state where the loom 1 is stopped to those for the sate where the loom 1 is in operation. Thus, an optimum pressure is applied to the roll 9 while the loom 1 is stopped to prevent the formation of creases in the cloth 8 when the weaving operation is resumed.

The operator operates a switch included in the loom controller 19 to start or stop a pressure applying operation for pressing the pressing member 34 against the roll 9 to facilitate work for unloading the roll 9 from the loom 1.

The tension control program is designed to reverse the cloth roller 14 automatically for a predetermined time to unwind the cloth 8 by a predetermined length upon the coincidence of the count counted by the pick counter included in the loom controller 19 with a predetermined number to slacken the cloth. Thus, a roll unloading operation can be automated. The pressure control program stops the pressing operation for applying pressure to the roll 9 automatically upon the coincidence of the count counted by the pick counter with the predetermined number. Thus, the roll unloading operation after the coincidence of the count counted by the counter with the predetermined number can be automated.

Figure 11:
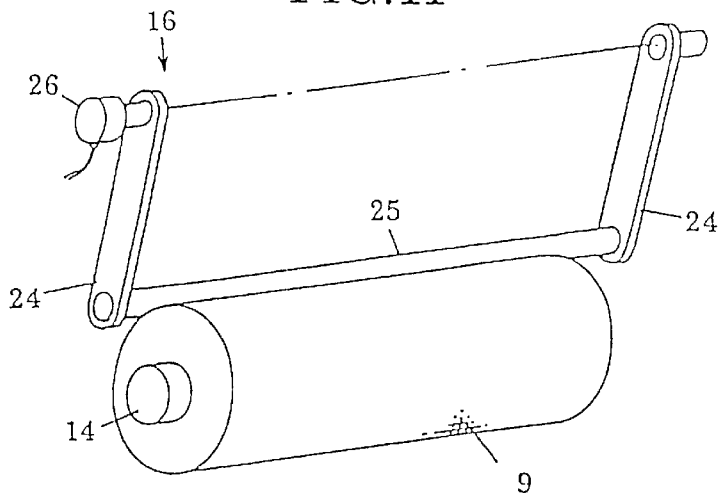
FIG. 11 is a perspective view of assistance in explaining a method of measuring the diameter of the roll of cloth.
Figure 12:
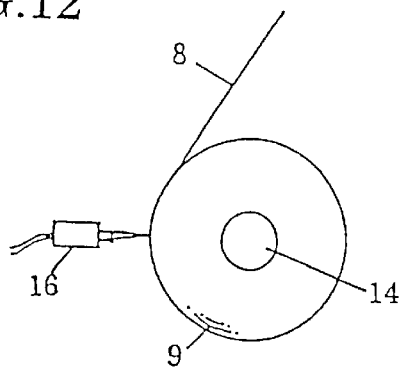
FIG. 12 is a side elevation of assistance in explaining a method of measuring the diameter of the roll of cloth.

FIGS. 11 and 12 show possible examples of the diameter measuring device 16. A diameter measuring device 16 shown in FIG. 11, similarly to that shown in FIG. 4, has a contact roller 25 having a length equal to or greater than the width of the cloth 8, having opposite ends rotatably supported on free ends of a pair of swing arms 24, and placed in contact with the roll 9. The angular position of the pair of swing arms 24 corresponds to the diameter of the roll 9. An angular position of the swing arms 24 is measured and converted into a corresponding diameter by a potentiometer 26. A diameter measuring device 16 shown in FIG. 12, similarly to that shown in FIG. 5, is a noncontact distance measuring device provided with a range sensor.

Figure 13:
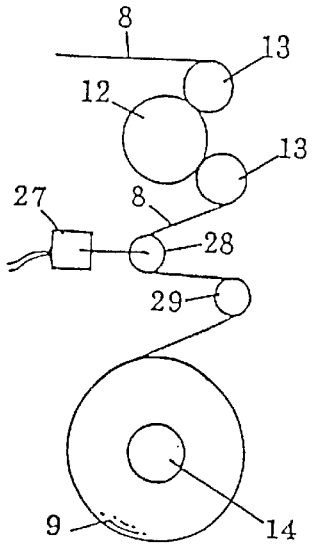
FIG. 13 is a side elevation of assistance in explaining a method of measuring tension exerted on the cloth.

FIG. 13 shows a tension measuring device. As shown in FIG. 13, a load cell 27, similarly to that shown in FIG. 6, is connected to a movable roller 28 supported for movement. The cloth 8 is extended along a Z-shaped path and is wound around the movable roller 28 and a stationary roller 29. The load cell 27 provides a signal representing a tension exerted on the cloth 8. A tension exerted on the cloth 8 corresponds to a winding torque applied to the cloth roller 14.

Figure 14:
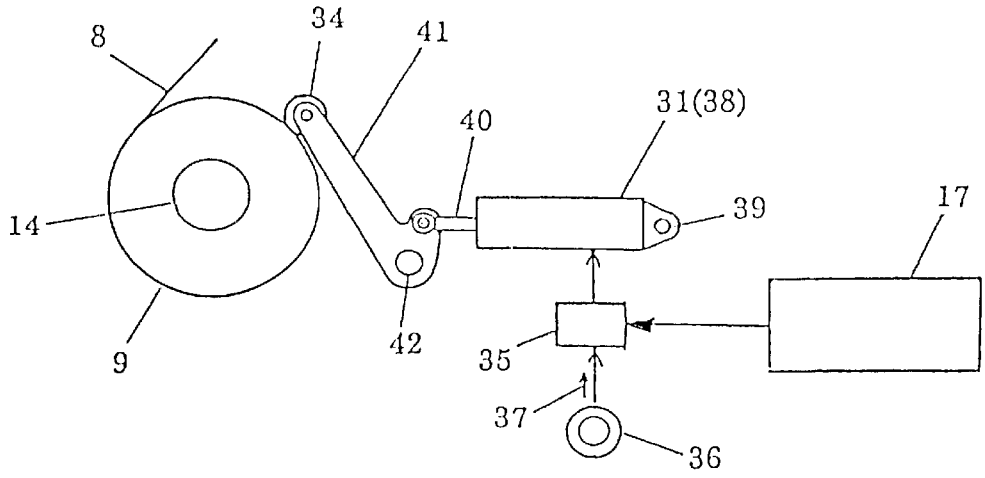
FIG. 14 is a side elevation of a pressure applying mechanism of a pressure control system employing a pneumatic cylinder actuator.
Figure 15:
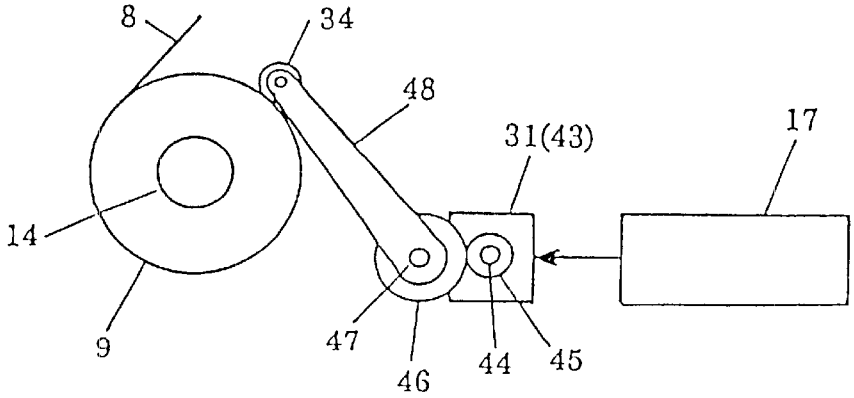
FIG. 15 is a side elevation of a pressure applying mechanism of a torque control system employing a motor.
Figure 16:
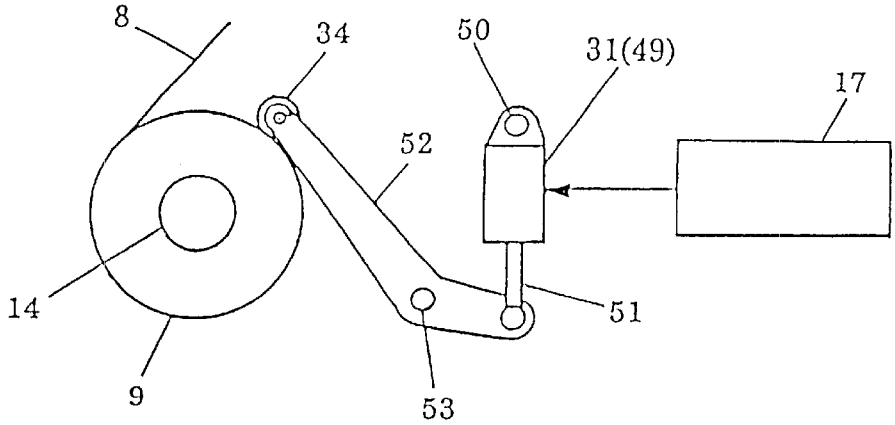
FIG. 16 is a side elevation of a pressure applying mechanism of an electromagnetic control system employing a solenoid actuator.

FIGS. 14, 15 and 16 show possible examples of the pressure applying mechanism 32 for operating the pressing member 34. The pressure applying mechanism 32 shown in FIG. 14 is of a pressure-control system employing a pneumatic cylinder actuator 38 serving as the actuator 31. The take-up controller 17 gives a signal to a pressure control valve 35. The pressure control valve 35 receives compressed air 37 from a compressed air source 36, adjusts the pressure of the compressed air 37 and supplies the compressed air 37 to the pneumatic cylinder actuator 38. The pneumatic cylinder actuator 38 includes a cylinder having one end pivotally supported on a pin 39, and a rod 40 connected to one of the arms of a lever 41. The pressing member 34 is supported on the other arm of the lever 41. The rod 40 is thrust out of the cylinder to turn the lever 41 counterclockwise, as viewed in FIG. 14, so that the pressing member 34 is pressed against the roll 9. Although the rod 40 of the pneumatic cylinder actuator 3 8 is thrust into the cylinder as the diameter of the roll 9 increases, the pressure control valve 35 adjusts the pressure in the working chamber of the pneumatic cylinder actuator 38 to a value suitable for the current diameter of the roll 9 determined by taking the weight of the pressing member 34 and such into consideration.

The pressure applying mechanism 32 shown in FIG. 16 is an electromagnetic control system employing a solenoid actuator 49 serving as the actuator 31. The take-up controller 17 gives a signal to the solenoid actuator 49. The solenoid actuator 49 has one end pivotally supported on a pin 50. The solenoid actuator 49 has a solenoid, and a rod 51 connected to one of the arms of a lever 52 supported on a pin 53. The pressing member 34 is supported on the other arm of the lever 52. When the solenoid of the solenoid actuator 49 is energized to retract the rod 51, the pressing member 34 is pressed against the roll 9. Power supplied to the solenoid is adjusted to adjust the pressure applied to the roll 9.

The pressure applying mechanism 32 shown in FIG. 16 is of an electromagnetic control system employing a solenoid actuator 49 as the actuator 31. The take-up controller 17 gives a signal to the solenoid actuator 49. The solenoid actuator 49 has one end pivotally supported on a pin 50. The solenoid actuator 49 has a solenoid, and a rod 51 connected to one of the arms of a lever 52 supported on a pin 53. The pressing member 34 is supported on the other arm of the lever 52. When the solenoid of the solenoid actuator 49 is energized to retract the rod 51, the pressing member 34 is pressed against the roll 9. Power supplied to the solenoid is adjusted to adjust the pressure applied to the roll 9.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A take-up motion control system for controlling a take-up motion of a loom, comprising:

a cloth roller;

a torque-controllable motor for rotating said cloth roller;

a diameter measuring device operable to measure a diameter of a roll of cloth wound around said cloth roller and to generate a diameter signal based on the measured diameter; and a take-up controller operable to control said torque-controllable motor based on a tension control program and based on the diameter signal generated by said diameter measuring device.

2. The take-up motion control system of claim 1, further comprising a setting device for determining a range of tensions for the roll of cloth based on weaving conditions, including a minimum diameter tension and a maximum diameter tension, said take-up controller being operable to execute said tension control program using the range of tensions to generate a tension for the roll of cloth having a diameter in a range from a minimum diameter, corresponding to a minimum diameter tension, and a maximum diameter, corresponding to a maximum diameter tension.

3. The take-up motion control system of claim 2, further comprising a display device connected to said take-up controller, said display device being operable to generate and display a graph indicating a relationship between the diameter of the roll of cloth and the range of tensions based on the tension control program, said take-up controller being operable to adjust the range of tensions based on a movement of a point or line of the graph displayed by said display device.

4. The take-up motion control system of claim 3, further comprising a tension measuring device connected to said take-up controller and operable to measure a tension of the cloth and generate a tension signal based on the measured tension, said take-up controller being operable to transmit the tension signal and the diameter signal to said display device, and said display device being operable to display the measured diameter and the measured tension based on the diameter signal and the tension signal, respectively.

5. The take-up motion control system of claim 2, wherein said take-up controller is operable to execute said tension control program to:

generate a tension for a state in which the loom is operating and for a state in which the loom is stopped;

generate a change from a control mode using the tension for the state in which the loom is operating to a control mode using the tension for the state in which the loom is stopped for a set stop time; and generate a change from a control mode using the tension for the state in which the loom is stopped to a control mode using the tension for the state in which the loom is operated for a set operating time.

6. The take-up motion control system of claim 1, wherein said take-up controller includes an operational switch, said take-up controller being operable to control a direction of rotation of said cloth roller according to a manipulation of said operational switch so as to rotate said cloth roller in a forward direction or a reverse direction.

7. The take-up motion control system of claim 6, wherein said take-up controller is operable to automatically stop a rotation of said cloth roller following a predetermined period of time after manipulation of said operational switch or following a predetermined amount of rotation corresponding to a predetermined length of cloth after manipulation of said operational switch.

8. The take-up motion control system of claim 1, further comprising a pick counting device for counting a number of picks, said take-up controller being operable to control said torque-controllable motor so as to stop rotation of said cloth roll and reverse rotation of said cloth roll for a predetermined period of time or a predetermined amount of rotation after said pick counting device counts a predetermined number of picks.

9. A take-up motion control system for controlling a take-up motion of a loom, comprising:

a cloth roller;

a pressing member to be placed in contact with a peripheral surface of a roll of cloth wound around said cloth roller, said pressing member having an axis of rotation parallel to an axis of rotation of said cloth roller;

a pressing actuator for pressing said pressing member against the roll of cloth and for adjusting a pressing force of said pressing member against the roll of cloth;

a diameter measuring device operable to measure a diameter of a roll of cloth wound around said cloth roller and to generate a diameter signal based on the measured diameter; and a take-up controller operable to control said pressing actuator based on a pressing control program and based on the diameter signal generated by said diameter measuring device, whereby said pressing member applies an appropriate adjusted pressure against the roll of cloth.

10. The take-up motion control system of claim 9, further comprising a setting device for determining a range of pressures for the roll of cloth based on the measured diameter of the roll of cloth, said take-up controller being operable to execute said pressure control program using the range of pressures to generate a pressure to be applied to the roll of cloth.

11. The take-up motion control system of claim 9, wherein said take-up controller includes an operational switch, said take-up controller being operable to start and stop an application of pressure against the roll of cloth by said pressing member according to a manipulation of said operational switch.

12. The take-up motion control system of claim 9, further comprising a pick counting device for counting a number of picks, said take-up controller being operable to control said pressing actuator so as to stop the application of pressure against the roll of cloth after said pick counting device counts a predetermined number of picks.

13. A take-up motion control system for controlling a take-up motion of a loom, comprising:

a cloth roller;

a pressing member to be placed in contact with a peripheral surface of a roll of cloth wound around said cloth roller, said pressing member having an axis of rotation parallel to an axis of rotation of said cloth roller;

a pressing actuator for pressing said pressing member against the roll of cloth and for adjusting a pressing force of said pressing member against the roll of cloth;

a setting device for determining a range of pressures for the roll of cloth based on a diameter of the roll of cloth; and a take-up controller operable to control said pressing actuator by executing a pressure control program using the range of pressures to generate a pressure to be applied to the roll of cloth.

14. The take-up motion control system of claim 13, further comprising a display device connected to said take-up controller, said display device being operable to generate and display a graph indicating a relationship between the diameter of the roll of cloth and the range of pressures based on said pressure control program, said take-up controller being operable to adjust the range of pressures based on a movement of a point or line of the graph displayed by said display device.

15. The take-up motion control system of claim 14, further comprising:

a pressure measuring device connected to said take-up controller and operable to measure a pressure applied to the roll of cloth and generate a pressure signal based on the measured pressure; and a diameter measuring device operable to measure a diameter of the roll of cloth wound around said cloth roller and to generate a diameter signal based on the measured diameter;

said display device being operable to display the measured diameter and the measured pressure based on the diameter signal and the pressure signal, respectively.

16. The take-up motion control system of claim 14, wherein said take-up controller is operable to execute said pressure control program to:

generate a pressure for a state in which the loom is operating and for a state in which the loom is stopped;

generate a change from a control mode using the pressure for the state in which the loom is operating to a control mode using the pressure for the state in which the loom is stopped for a set stop time; and generate a change from a control mode using the pressure for the state in which the loom is stopped to a control mode using the pressure for the state in which the loom is operated for a set operating time.

17. The take-up motion control system of claim 13, wherein said take-up controller is operable to execute said pressure control program to:

generate a pressure for a state in which the loom is operating and for a state in which the loom is stopped;

generate a change from a control mode using the pressure for the state in which the loom is operating to a control mode using the pressure for the state in which the loom is stopped for a set stop time; and generate a change from a control mode using the pressure for the state in which the loom is stopped to a control mode using the pressure for the state in which the loom is operated for a set operating time.

18. A take-up motion control system for controlling a take-up motion of a loom, comprising:

a cloth roller;

a pressing member to be placed in contact with a peripheral surface of a roll of cloth wound around said cloth roller, said pressing member having an axis of rotation parallel to an axis of rotation of said cloth roller;

a pressing actuator for pressing said pressing member against the roll of cloth and for adjusting a pressing force of said pressing member against the roll of cloth; and a take-up controller operable to control said pressing actuator by executing a pressure control program to generate a pressure to be applied to the roll of cloth according to weaving conditions, said take-up controller including an operational switch, said take-up controller being operable to start and stop an application of pressure against the roll of cloth by said pressing member according to a manipulation of said operational switch.

19. A take-up motion control system for controlling a take-up motion of a loom, comprising:

a cloth roller;

a pressing member to be placed in contact with a peripheral surface of a roll of cloth wound around said cloth roller, said pressing member having an axis of rotation parallel to an axis of rotation of said cloth roller;

a pressing actuator for pressing said pressing member against the roll of cloth and for adjusting a pressing force of said pressing member against the roll of cloth;

a pick counting device for counting a number of picks; and a take-up controller operable to control said pressing actuator by executing a pressure control program to generate a pressure to be applied to the roll of cloth according to weaving conditions, and being operable to control said pressing actuator so as to stop the application of pressure against the roll of cloth after said pick counting device counts a predetermined number of picks.

* * * * *